US010008788B2

(12) United States Patent
Meng et al.

(10) Patent No.: US 10,008,788 B2
(45) Date of Patent: Jun. 26, 2018

(54) INTERMEDIATE GROUND FOR VEHICLES

(71) Applicant: Toyota Motor Engineering & Manufacturing North America, Inc., Erlanger, KY (US)

(72) Inventors: Ming M. Meng, Novi, MI (US); Alexander N. Barrus, Milan, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 49 days.

(21) Appl. No.: 14/919,793

(22) Filed: Oct. 22, 2015

(65) Prior Publication Data

US 2017/0117624 A1 Apr. 27, 2017

(51) Int. Cl.

| | |
|---|---|
| ***H01R 4/64*** | (2006.01) |
| ***H01R 11/07*** | (2006.01) |
| ***H01Q 1/32*** | (2006.01) |
| ***H01R 13/655*** | (2006.01) |
| ***H01Q 1/48*** | (2006.01) |
| *H01Q 1/12* | (2006.01) |

(52) U.S. Cl.

CPC ..... *H01R 4/64* (2013.01); *H01Q 1/3291* (2013.01); *H01Q 1/48* (2013.01); *H01R 11/07* (2013.01); *H01R 13/655* (2013.01); *H01Q 1/1271* (2013.01); *H01R 2201/26* (2013.01)

(58) Field of Classification Search

None

See application file for complete search history.

(56) References Cited

U.S. PATENT DOCUMENTS

| | | | | |
|---|---|---|---|---|
| 4,184,160 | A | 1/1980 | Affronti | |
| 2008/0194126 | A1* | 8/2008 | Grant | H01R 11/12 439/108 |
| 2010/0112858 | A1* | 5/2010 | Takayama | H01R 4/20 439/585 |
| 2012/0302089 | A1* | 11/2012 | Shuey | H01R 11/07 439/386 |
| 2013/0249747 | A1 | 9/2013 | Hijirikawa | |
| 2016/0372814 | A1* | 12/2016 | Murakami | H01Q 9/30 |

* cited by examiner

*Primary Examiner* — Robert Karacsony

(74) *Attorney, Agent, or Firm* — Christopher G. Darrow; Darrow Mustafa PC

(57) ABSTRACT

An intermediate ground is provided in a vehicle. The intermediate ground can be located between one or more antennas and one or more processing systems. The intermediate ground can include a vehicle frame member (e.g., part of an A-pillar) and a ground bracket attached to the vehicle frame member. The ground bracket can include a body made of a conductive material. The body can include a first end region and a second end region opposite to the first end region. The first end region can include a frame engaging portion. At least a portion of the frame engaging portion can directly contact the vehicle frame member. The second end region being configured to support a plurality of electrical connectors thereon. The body can include an anti-rotation tab extending from the frame engaging portion. The anti-rotation tab can engage the vehicle frame member.

11 Claims, 5 Drawing Sheets

INTERMEDIATE GROUND FOR VEHICLES

FIELD

The subject matter described herein relates in general to vehicles and, more particularly, to vehicles including a plurality of antennas.

BACKGROUND

Modern vehicles include various systems that include an antenna. Examples of such systems include AM/FM radio, satellite radio (e.g., Satellite Digital Audio Radio System (SDARS)), telematics, and satellite navigation (e.g., Global Positioning System (GPS)). Signals received by the antennas are delivered to a processing unit by cables. In many instances, the cables must span long distances. Due to the length of the cables and the presence of other electromagnetic waves in the vehicle from other electrical systems, electrical noise can interfere with the antenna signals. To reduce noise, one or more intermediate ground points are provided between the antenna and the processing unit.

SUMMARY

In one respect, the subject matter described herein is directed to a ground bracket. The ground bracket includes a body. The body can be made of an electrically conductive material. The body can include a first end region and a second end region. The second end region can be opposite to the first end region. The first end region can include a frame engaging portion. The second end region can include a first electrical connector supporting portion and a second electrical connector supporting portion. The first electrical connector supporting portion can include a first post. The second electrical connector supporting portion can include a second post. The first post and the second post can be configured to support an electrical connector thereon. The body can include an anti-rotation tab. The anti-rotation tab can extend transversely from the frame engaging portion. The anti-rotation tab can be substantially located on a different side of the body than the first and second posts.

In another respect, the subject matter described herein is directed to a ground system for a vehicle. The system can include a vehicle frame member. The system can also include a ground bracket attached to the vehicle frame member. The ground bracket can include a body made of a conductive material. The body can include a first end region and a second end region opposite to the first end region. The first end region can include a frame engaging portion. At least a portion of the frame engaging portion can directly contact the vehicle frame member. The second end region can be configured to separately support a plurality of electrical connectors thereon.

In still another respect, the subject matter described herein is directed to an intermediate ground system for a vehicle. The system can include a first set of one or more antennas and a second set of one or more antennas. The system can also include an intermediate ground. The intermediate ground can include a vehicle frame member and a ground bracket attached to the vehicle frame member. The ground bracket can be made of a conductive material. The ground bracket can include a first end region and a second end region. The first end region including a frame engaging portion. At least a portion of the frame engaging portion can directly contact the vehicle frame member. The second end region can be configured to support a plurality of electrical connectors thereon.

The system can include a first set of one or more conductors. The first set of one or more conductors can be operatively connected at one end to the first set of one or more antennas. The first set of one or more conductors can be operatively connected at an opposite end to a first electrical connector. The system can include a second set of one or more conductors. The second set of one or more conductors can be operatively connected at one end to the second set of one or more antennas. The second set of one or more conductors can be operatively connected at an opposite end to a second electrical connector. The first electrical connector and the second electrical connector can be supported on the second end region of the ground bracket.

DETAILED DESCRIPTION

Figure 1:
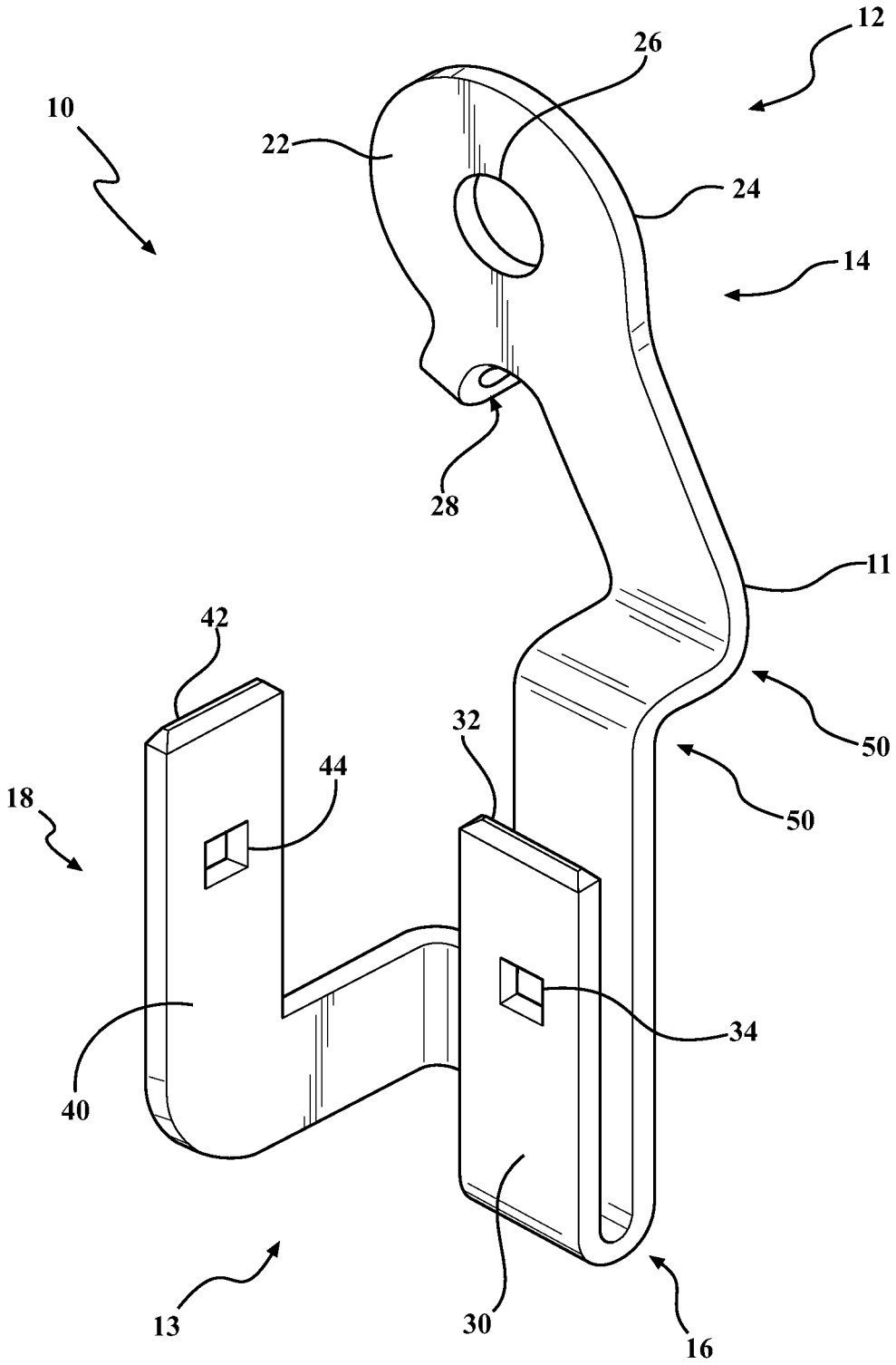
FIG. 1 is an example of a ground bracket.

This detailed description relates to electrical grounds provided in a vehicle. This detailed description is more particularly related to intermediate electrical grounds provided between one or more antennas and one or more processing units. An intermediate ground can include a ground bracket attached to a vehicle frame member (e.g., an A-pillar). The ground bracket can be made of a conductive material. The ground bracket can include a first end region and a second end region. The second end region can be opposite to the first end region. The first end region can be configured to engage a vehicle frame member. The second end region can be configured to support a plurality of electrical connectors thereon. The present detailed description relates to apparatus and/or systems that incorporate one or more of such features. In at least some instances, arrangements described herein can reduce packaging space within a vehicle, and/or improve signal to noise ratio of received antenna signals.

Detailed embodiments are disclosed herein; however, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-7, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

An electrical ground, such as an intermediate ground, can be provided in a vehicle in any suitable manner. For instance, in one or more arrangements, an electrical ground can include a ground bracket. FIG. 1 shows one example of a ground bracket 10. The ground bracket 10 can be made of any suitable material. For instance, the ground bracket 10 can be made out of a material that is electrically conductive. Alternatively or in addition, the ground bracket 10 can be made of a material that has sufficient strength to withstand expected vibrations and/or other forces during vehicle operation or other condition(s). In one or more arrangements, the ground bracket 10 can be made of steel.

The ground bracket 10 can be made using any suitable process, including, for example, stamping, bending, and/or cutting. In one or more arrangements, the ground bracket 10 can be formed as a single piece. In one or more arrangements, the ground bracket 10 can be made of a plurality of separate pieces. The plurality of separate pieces can be joined together in any suitable manner, including, for example, welding, brazing, and/or one or more fasteners.

The ground bracket 10 can have a body 11. The body 11 can have any suitable size, shape, and/or configuration. For instance, the body 11 can include a first end region 12 and a second end region 13. The first end region 12 and the second end region 13 can be generally on opposite ends of the body 11.

The first end region 12 can be configured to engage a frame member of a vehicle. For instance, the first end region 12 can include a frame engaging portion 14. The second end region 13 can be configured to support a plurality of electrical connectors thereon. For instance, in one or more arrangements, the second end region 13 can be configured to support two electrical connectors thereon. As an example, the second end region 13 can include a first electrical connector supporting portion 16 and a second electrical connector supporting portion 18.

In one or more arrangements, the second end region 13 can be configured to separately support a plurality of electrical connectors thereon. "Separately support" means the plurality of electrical connectors are supported on different electrical connector supporting portions of the second end region. In some instances, "separately support" can include arrangements in which each electrical connector supported on the ground bracket is not supported by another one of the electrical connectors that is also supported on the ground bracket. In some instances, "separately support" can include arrangements in which each electrical connector supported on the ground bracket does not contact another one of the electrical connectors that is also supported on the ground bracket.

The frame engaging portion 14 can have an inner side 22 and an outer side 24. The terms "inner" and "outer" are used in this respect with respect to the interior of the vehicle when the ground bracket is installed in its intended positon. The terms are used merely for convenience to facilitate the description. Therefore, it will be understood that these terms are not intended to be limiting. The outer side 24 can be substantially flat. The inner side 22 can be substantially flat. As used herein, the term "substantially" includes exactly the term it modifies and slight variations therefrom. Thus, for example, the term "substantially flat" means exactly flat and slight variations therefrom (e.g., within normal manufacturing tolerances).

The ground bracket 10 can include one or more features to facilitate attachment to a vehicle frame member. For instance, a through hole 26 can be defined by the frame engaging portion 14. The through hole 26 can have any suitable size, shape, and/or conformation. In one or more arrangements, the through hole 26 can be substantially circular, as is shown in FIG. 1. However, it will be understood that other shapes are possible. The through hole 26 can be configured to receive at least a portion of a fastener (e.g., a screw, a bolt, a pin, etc.). In one or more arrangements, the through hole 26 can be configured to receive at least a portion of an M6 bolt.

The ground bracket 10 can include one or more features to prevent rotation or other unwanted movement of the ground bracket 10. For instance, the ground bracket 10 can include an anti-rotation tab 28. The anti-rotation tab 28 can be provided in any suitable location on the ground bracket 10. As an example, the anti-rotation tab 28 can be provided in the frame engaging portion 14 of the ground bracket 10.

The anti-rotation tab 28 can have any suitable size, shape, and/or configuration. In one or more arrangements, the anti-rotation tab 28 can be substantially rectangular. However, it will be understood that the anti-rotation tab 28 not limited to such a configuration. Indeed, the anti-rotation tab 28 can be substantially cylindrical, substantially polygonal, substantially semi-circular, and/or any irregular shape, just to name a few possibilities.

Figure 2:
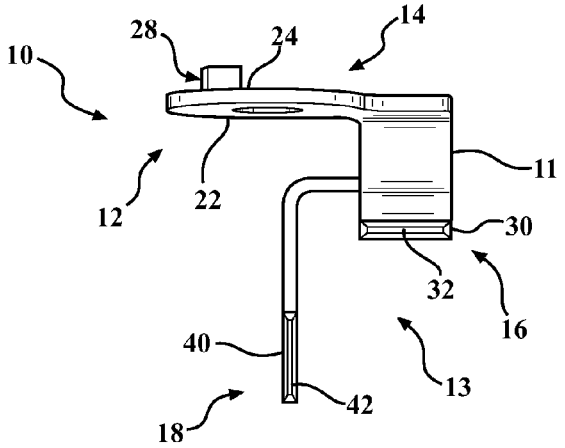
FIG. 2 is a view of the ground bracket.
Figure 4:
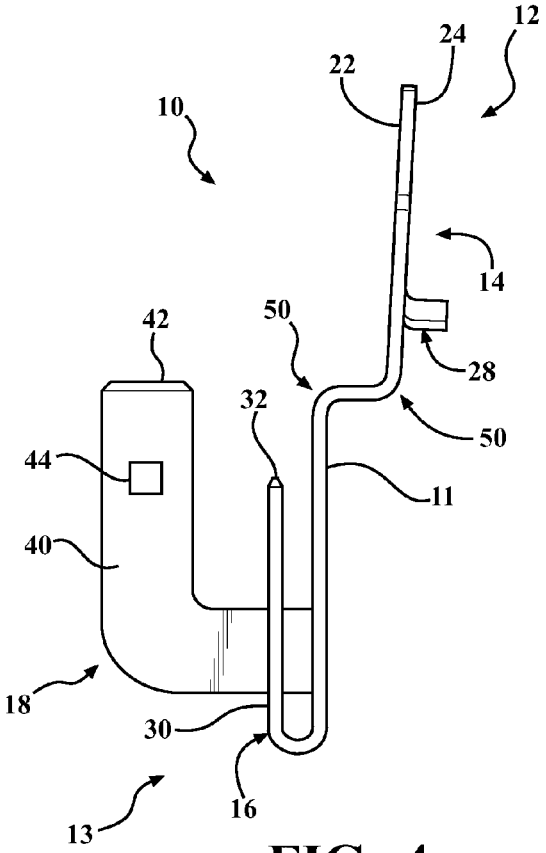
FIG. 4 is a view of the ground bracket.

The anti-rotation tab 28 can extend from any suitable portion of the body 11. For instance, in one or more arrangements, the anti-rotation tab 28 can extend from the frame engaging portion 14 of the body 11. More particularly, the anti-rotation tab 28 can extend transversely to the frame engaging portion 14 of the body 11. In one or more arrangements, the anti-rotation tab 28 can extend from the outer side 24 of the frame engaging portion 14, as is shown in FIGS. 2 and 4. The anti-rotation tab 28 can extend at any suitable angle relative to the frame engaging portion 14. For instance, the anti-rotation tab 28 can extend at about 90 degrees relative to the frame engaging portion 14. In some instances, the anti-rotation tab 28 can extend at an acute angle or an obtuse angle relative to the frame engaging portion 14.

As noted above, the second end region 13 of the ground bracket 10 can include the first electrical connector supporting portion 16. The first electrical connector supporting portion 16 can be configured to support a first electrical connector. The first electrical connector supporting portion 16 can have any suitable configuration. For instance, in one or more arrangements, the first electrical connector supporting portion 16 can be generally U-shaped (see FIGS. 1-4), generally C-shaped, or generally J-shaped.

The first electrical connector supporting portion 16 can include any suitable structure(s). For instance, the first electrical connector supporting portion 16 can include a first connector post 30. The first connector post 30 can have any suitable size, shape, and/or configuration. In one or more arrangements, the first connector post 30 can be substantially rectangular. In one or more arrangements, the first connector post 30 can have a substantially rectangular cross-sectional shape. In one or more arrangements, the first connector post 30 can be sized to be received in a portion of an electrical connector. The first connector post 30 can include a distal end 32. The distal end 32 can have any suitable configuration. In one or more arrangements, the distal end 32 can be tapered.

In one or more arrangements, the first connector post 30 can be configured to retainably engage an electrical connector supported thereon. For instance, some electrical connectors can include a protrusion. The first connector post 30 can include one or more features to receive and/or otherwise engage the protrusion. For instance, the first connector post 30 can define an aperture 34. The aperture 34 can be formed in any suitable portion of the first connector post 30.

In one or more arrangements, the aperture 34 can extend through the entire thickness of the first connector post 30. In one or more arrangements, the aperture 34 can extend at a depth into the thickness of the first connector post 30 without extending through the entire thickness of the first connector post 30. The aperture 34 can have any suitable configuration. For instance, in one or more arrangements, the aperture 34 can be substantially rectangular, as is shown in FIG. 1. However, it will be understood that the aperture 34 can have any suitable shape.

As noted above, the second end region 13 of the ground bracket 10 can include the second electrical connector supporting portion 18. The second electrical connector supporting portion 18 can be configured to support a second electrical connector. The second electrical connector supporting portion 18 can have any suitable configuration. In one or more arrangements, the second electrical connector supporting portion 18 can have generally the same configuration as the first electrical connector supporting portion 16. In one or more arrangements, the second electrical connector supporting portion 18 can have a different configuration as the first electrical connector supporting portion 16. For instance, in one or more arrangements, the second electrical connector supporting portion 18 can be generally L-shaped, as is shown in FIGS. 1-4. In one or more arrangements, the second electrical connector supporting portion 18 can branch from the first electrical connector supporting portion 16.

The second electrical connector supporting portion 18 can include a second connector post 40. The second connector post 40 can have any suitable size, shape, and/or configuration. In one or more arrangements, the first connector post 30 and the second connector post 40 can have substantially the same configuration. In one or more arrangements, the second connector post 40 can be substantially rectangular. In one or more arrangements, the second connector post 40 can have a substantially rectangular cross-sectional shape. In one or more arrangements, the second connector post 40 can be sized to be received in a portion of an electrical connector. The second connector post 40 can include a distal end 42. The distal end 42 can have any suitable configuration. In one or more arrangements, the distal end 42 can be tapered.

In one or more arrangements, the second connector post 40 can be configured to retainably engage an electrical connector thereon. For instance, some electrical connectors can include a protrusion. The second connector post 40 can include one or more features to receive and/or engage the protrusion. For instance, the second connector post 40 can define an aperture 44. The aperture 44 can be formed in any suitable portion of the connector post 40. The above discussion of the aperture 34 in connection with the first connector post 30 applies equally to the aperture 44.

The apertures 34, 44 can be located at a distance from the distal end 32, 42 of their respective connector post 30, 40. In one or more arrangements, the apertures 34, 44 can be located at substantially the same distance from the distal end 32, 42 of their respective connector post 30, 40. However, in other arrangements, the apertures 34, 44 can be located at different distances from the distal end 32, 42 of their respective connector post 30, 40. In one or more arrangements, at least one of the apertures 34, 44 can be centered in a width direction of the respective connector post 30, 40. In one or more arrangements, at least one of the apertures 34, 44 can be offset in the width direction of the respective connector post 30, 40.

The first connector post 30 and the second connector post 40 can be oriented in any suitable manner relative to each other. For instance, the first connector post 30 and the second connector post 40 be oriented at an angle relative to each other. In one or more arrangements, the first connector post 30 and the second connector post 40 can be oriented at substantially 90 degrees relative to each other. However, it will be appreciated that there can be any suitable angle between the first connector post 30 and the second connector post 40.

Figure 3:
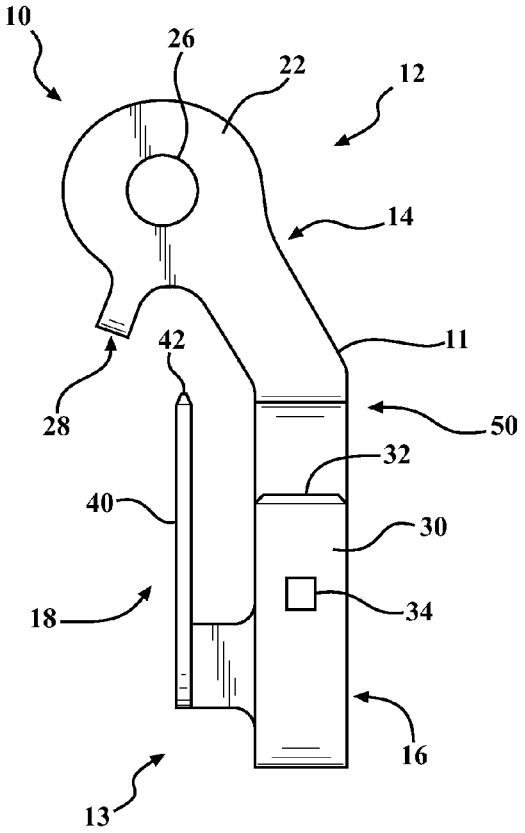
FIG. 3 is a view of the ground bracket.

In one or more arrangements, the distal end 32 of the first connector post 30 and the distal end 42 of the second connector post 40 can be substantially aligned with each other. In one or more arrangements, the distal end 32 of the first connector post 30 and the distal end 42 of the second connector post 40 can be offset from each other, as is shown in FIGS. 3-4. As an example, the distal end 42 of the second connector post 40 can be higher than the distal end 32 of the first connector post 30. It will be appreciated that the term "higher" is used merely for convenience to facilitate the description. Indeed, the ground bracket 10 can be installed in any suitable orientation, and not necessarily in the orientation shown in FIGS. 1-4.

The body 11 can have any suitable configuration between the first end region 12 and the second end region 13. In one or more arrangements, the body 11 can include one or more non-straight or non-flat features between the frame engaging portion 14 and the first and second electrical connector supporting portions 16, 18. For instance, the body 11 can include one or more bends 50, steps, or other non-straight feature.

There can be any suitable relationship between the frame engaging portion 14 and the first electrical connector supporting portion 16. For instance, in one or more frame engaging portion 14 can be substantially parallel to the first connector post 30. As another example, in one or more arrangements, the frame engaging portion 14 can be angled or otherwise non-parallel to the first connector post 30. In one or more arrangements, the through hole 26 in the frame engaging portion 14 can be laterally offset from the first connector post 30, as is shown, for example, in FIG. 3. In one or more arrangements, a majority of the frame engaging portion 14 can be laterally offset from the first connector post 30, as is shown, for example, in FIG. 3.

There can be any suitable relationship between the frame engaging portion 14 and the second electrical connector supporting portion 18. In one or more arrangements, the frame engaging portion 14 can be angled at substantially 90 degrees relative to the second connector post 40. In one or more arrangements, the second connector post 40 can be substantially aligned with the through hole 26, as is shown in FIG. 3. In one or more arrangements, the anti-rotation tab 28 can be located laterally outboard of the second connector post 40, as is shown in FIG. 3.

In one or more arrangements, the first electrical connector supporting portion 16 and the second electrical connector supporting portion 18 can be located on the same side of the frame engaging portion 14. For instance, the first electrical connector supporting portion 16 and the second electrical connector supporting portion 18 can be located on the inner side 22 of the frame engaging portion 14. Thus, the first connector post 30 and the second connector post 40 can be located on the inner side 22 of the frame engaging portion 14. In one or more arrangements, the anti-rotation tab 28 can be located on and/or extend from a different side of the frame engaging portion 14 than the first and second posts 30, 40. For instance, the anti-rotation tab 28 can be located on and/or extend from the outer side 24 of the frame engaging portion 14, and the first and second posts 30, 40 can be located on the inner side 22 of the frame engaging portion 14.

Figure 5:
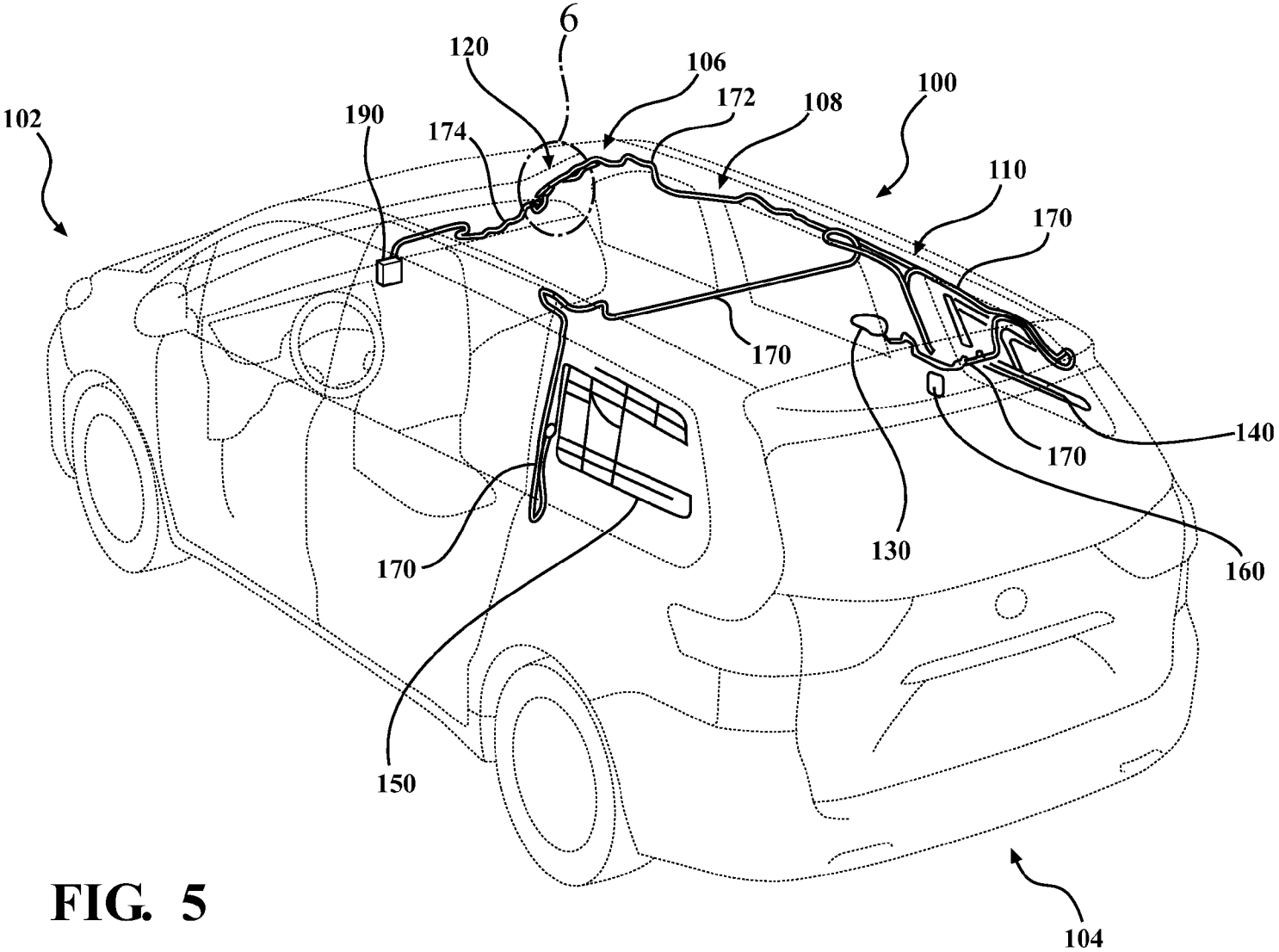
FIG. 5 is an example of a vehicle, showing an example of a location for an intermediate ground.

Now that the ground bracket 10 has been described, an example of an environment in which the ground bracket 10 can be used will be described. In one or more arrangements, the ground bracket 10 can be used in a vehicle. Referring to FIG. 5, an example of a vehicle 100 is shown. As used herein, "vehicle" means any form of motorized transport. In one or more implementations, the vehicle 100 can be an automobile. While arrangements will be described herein with respect to automobiles, it will be understood that embodiments are not limited to automobiles. In some implementations, the vehicle 100 may be a watercraft, an aircraft, a train, or any other form of motorized transport. The vehicle can include a front end 102 and a back end 104.

The vehicle 100 can include a plurality of antenna based systems. An "antenna based system" is any system that includes an antenna. For instance, the vehicle 100 can include the following antenna based systems: AM/FM radio, satellite radio (e.g., Satellite Digital Audio Radio System (SDARS)), telematics, and satellite navigation (e.g., Global Positioning System (GPS)). Some of these systems include antennas located near the back end 104 of the vehicle 100. For instance, the vehicle 100 can include one or more satellite radio and/or one or more satellite navigation antennas 130. In some instances, one or more satellite radio and one or more satellite navigation antennas can be enclosed within a single housing (e.g., a shark fin-style antenna). In one or more arrangements, an amplifier 160 can be associated with the one or more satellite radio and/or one or more satellite navigation antennas 130. The vehicle 100 can include one or more AM/FM antennas. In one or more arrangements, the AM/FM antennas can include a right side glass antenna 140 and a left side glass antenna 150. The various antennas can be located closer to the back end 104 of the vehicle 100 than the front end 102.

Signals received by the various antennas can be delivered to one or more processing units 190. The processing unit 190 can include one or more processors. Examples of suitable processors include microprocessors, microcontrollers, DSP processors, and other circuitry that can execute software. Further examples of suitable processors include, but are not limited to, a central processing unit (CPU), an array processor, a vector processor, a digital signal processor (DSP), a field-programmable gate array (FPGA), a programmable logic array (PLA), an application specific integrated circuit (ASIC), programmable logic circuitry, and a controller. The processor can include at least one hardware circuit (e.g., an integrated circuit) configured to carry out instructions contained in program code. The processing unit can include one or more other components, including, for example, one or more data stores and/or an input/output system, just to name a few possibilities. The one or more processing units 190 may include an in-vehicle display that may also be a display or interface for a plurality of vehicle systems (e.g., a navigation system, a radio or audio system, and/or a display or monitoring system).

Examples of such processing units include a data communication module and/or a head unit of the vehicle 100. The one or more processing units 190 can be located near the front end 102 of the vehicle 100. For instance, the one or more processing units 190 can be located in an instrument panel of the vehicle 100.

The plurality of antennas 130, 140, 150 can receive signals from outside the vehicle 100. The received signals can be routed to the processing unit 190. The plurality of antennas 130, 140, 150 can be operatively connected to the processing unit 190 in any suitable manner. The term "operatively connected," as used throughout this description, can include direct or indirect connections, including connections without direct physical contact.

In one or more arrangements, the plurality of antennas 130, 140, 150 can be operatively connected to the processing unit 190 via conductors 170. Any suitable conductors 170 can be used. In one or more arrangements, the conductors 170 can be provided as electrical cables. In some instances, two or more of the conductors 170 can be provided in the same cable. A separate conductor 170 can be provided for each of the antennas 130, 140, 150. The individual conductors 170 can be shielded or unshielded. The conductors 170 can be routed through the vehicle 100 in any suitable manner. In one or more arrangements, at least a portion of the conductors 170 can be routed in and/or through a headliner assembly of the vehicle 100. The plurality of conductors 170 or any subset thereof can be bundled together in any suitable manner. For instance, FIG. 5 shows an example in which the conductors 170 for the antennas 130, 140, 150 are bundled together in an antenna conductor assembly.

An intermediate ground 120 can be provided at some point along the length of the plurality of conductors 170. In such case, the plurality of conductors 170 can include a first portion 172 and a second portion 174. The first portion 172 of the plurality of conductors 170 can be operatively connected between the antenna(s) 130, 140, 150 and the intermediate ground 120. The second portion 174 of the plurality of conductors 170 can be operatively connected between the intermediate ground 120 and the processing unit 190.

In one or more arrangements, the intermediate ground 120 can include the ground bracket 10. The ground bracket 10 can be installed in any suitable location in the vehicle 100. For instance, the ground bracket 10 can be attached to a frame member of the vehicle 100. The frame member can be made of an electrically conductive material, such as a metal. The vehicle 100 can include a plurality of frame members. For instance, the vehicle 100 can include a plurality of substantially vertical pillars supporting a roof structure. Going from the front end 102 to the back end 104 of the vehicle 100, the vehicle 100 can include an A-pillar 106, a B-pillar 108, and a C-pillar 110. In one or more arrangements, the ground bracket 10 can be installed on the A-pillar 106, as is generally indicated in FIG. 5.

Figure 6:
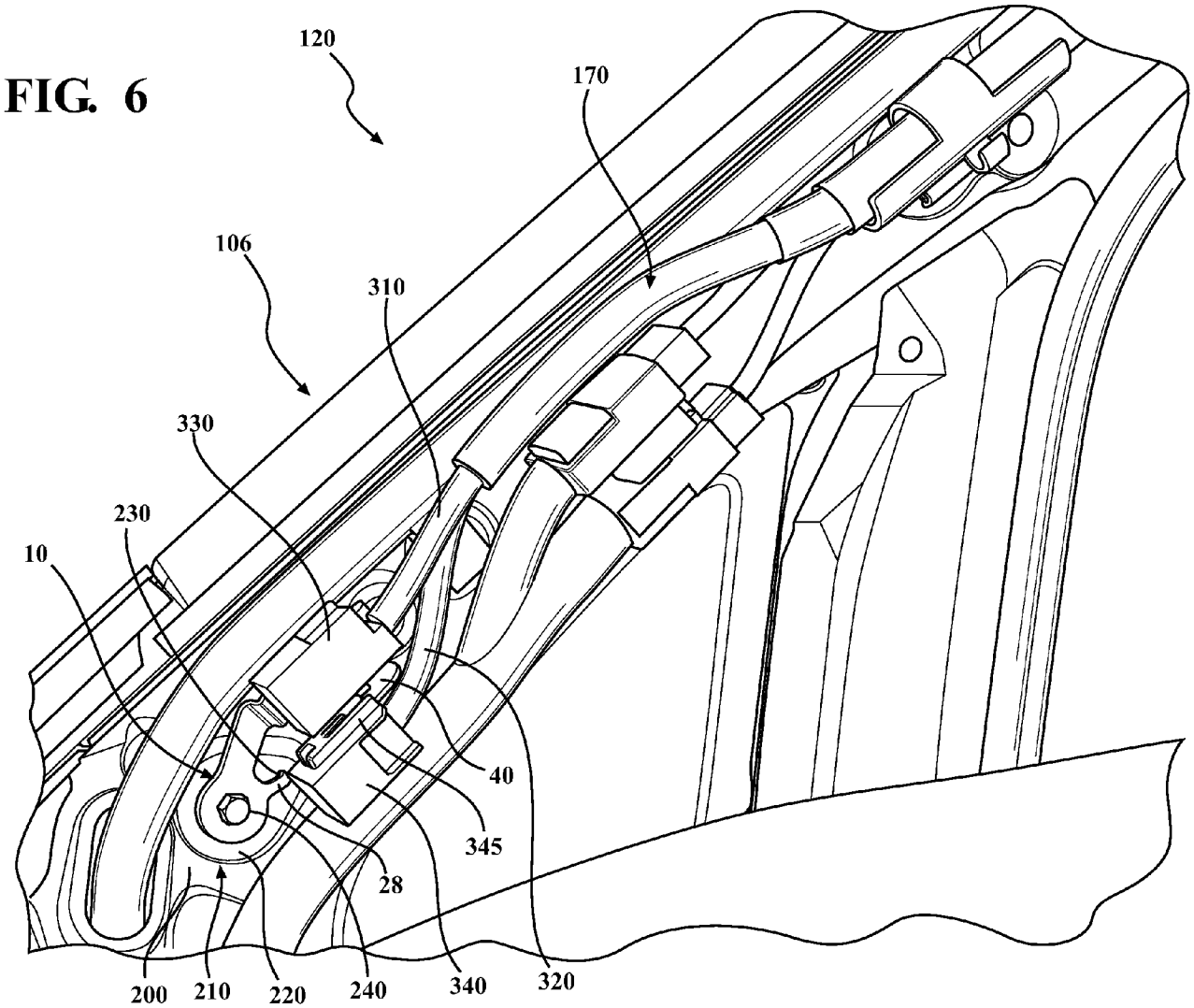
FIG. 6 is a close-up view of a portion of the vehicle, showing one example of an intermediate ground.

FIG. 6 shows is a close-up view of a portion of the vehicle 100, showing an example intermediate ground 120 at the location indicated in FIG. 5. Typically, a trim panel is installed to cover the components. However, for the sake of clarity, the trim panel is removed to show the components beneath.

The intermediate ground 120 can include a vehicle frame member 200. In one or more arrangements, the vehicle frame member 200 can be at least a portion of the A-pillar 106. The vehicle frame member 200 can be made of any suitable conductive material. For instance, the vehicle frame member 200 can be made of metal, such as steel. The vehicle frame member 200 can include a ground bracket engaging region 210. The ground bracket engaging region 210 can be configured to engage a portion of the ground bracket 10. For example the ground bracket engaging region 210 can be configured to engage the frame engaging portion 14 (e.g., the outer side 24 thereof) of the ground bracket 10.

There can be any suitable engagement between the vehicle frame member 200 and the ground bracket 10. For example, the ground bracket engaging region 210 and the ground bracket 10 can engage each other by direct contact. In one or more arrangements, the ground bracket engaging region 210 can be configured to substantially matingly engage the frame engaging portion 14 (e.g., the outer side 24 thereof) of the ground bracket 10. In one or more arrangements, the ground bracket engaging region 210 can include a substantially flat surface 220. In one or more arrangements, the ground bracket engaging region 210 can be raised or otherwise project away from at least the surrounding portions of the vehicle frame member 200, as is shown in FIG. 6.

The ground bracket engaging region 210 can be configured to facilitate the attachment to the ground bracket 10. For instance, the ground bracket engaging region 210 can define an aperture (not shown) for receiving a fastener (e.g., a bolt 240) to attach the ground bracket 10 to the vehicle frame member 200. In one or more arrangements, the aperture can be configured to threadably engage the fastener. In one or more arrangements, a retainer element (e.g., a nut) can engage the fastener.

In one or more arrangements, the vehicle frame member 200 can include one or more features for engaging the anti-rotation tab 28 of the ground bracket 10. As an example, the vehicle frame member 200 can define one or more apertures 230. The one or more apertures 230 can receive at least a portion of the anti-rotation tab 28 of the ground bracket 10.

At or near the intermediate ground 120, the first portion 172 of the plurality of conductors 170 can separate into a first set 310 and a second set 320. The first set 310 can include one or more of the plurality of the conductors 170, and the second set 320 can include one or more of the plurality of the conductors 170. The first set 310 can include a first connector 330. The first set 310 of one or more conductors 170 can be operatively connected at one end to the first connector 330. The second set 320 can include a second connector 340. The second set 320 of one or more conductors 170 can be operatively connected at one end to the second connector 340. The first connector 330 and the second connector 340 can be the same, or they can be different in one or more respects (e.g., type, size, shape, quantity of associated conductors, etc.). In one or more arrangements, the first connector 330 and/or the second connector 340 can be male connectors. In one or more arrangements, the first connector 330 and/or the second connector 340 can be female connectors. The first and/or second connectors 330, 340 can be any standard connector, now known or later developed.

Figure 7:
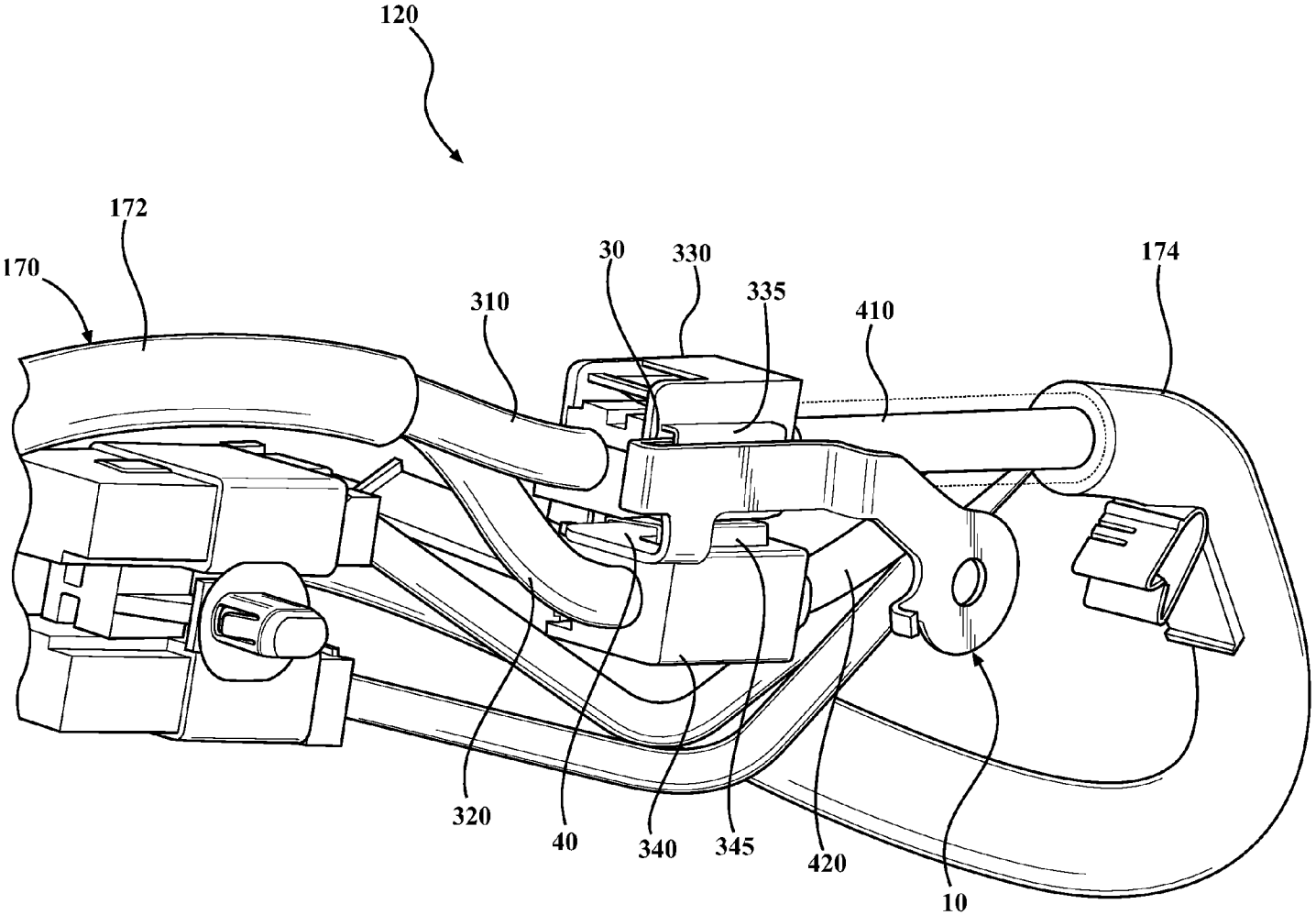
FIG. 7 is an alternative view of the intermediate ground of FIG. 6.

The first connector 330 can include a first cassette 335 (see FIG. 7). The second connector 340 can include a second cassette 345 (see FIGS. 6 and 7). The first and second cassettes 335, 345 can be female cassettes. The first and second cassettes 335, 345 can receive a respective one of the connector posts 30, 40 of the ground bracket 10. The first and second cassettes 335, 345 can include a protrusion (not shown) that can be received in and/or otherwise engage the aperture 34, 44 formed in the respective connector post 30, 40.

When the connector posts 30, 40 are received in their respective cassette 335, 345, an electrical connection can be established between the ground bracket 10 and the conductors 170 associated with the respective first or second connector 330, 340. With the ground bracket 10 attached to the vehicle frame member 200, the intermediate ground 120 can be established.

Each of the conductors 170 can be associated with a respective antenna. The first set 310 of one or more conductors 170 can carry signals received by the one or more antennas operatively connected thereto. Likewise, the second set 320 of one or more conductors 170 can carry signals received by the one or more antennas operatively connected thereto. The signals can have an associated frequency. The first set 310 of one or more conductors 170 can carry signals having a frequency in the range from about 500 kilohertz (kHz) to about 110 megahertz (MHz). In one or more arrangements, the first set 310 of one or more conductors 170 can include a conductor for AM/FM radio and a conductor for FM sub. The AM radio signals can have an associated frequency range. For instance, the AM radio signals can have a frequency range of from about 535 kHz to about 1,605 kHz. The FM radio signals can have a frequency range of from about 88 MHz to about 108 MHz.

The second set 320 of one or more conductors 170 can carry signals having a frequency in the range from about 800 megahertz to about 2.4 gigahertz. In one or more arrangements, the second set 320 of one or more conductors 170 can include a conductor for satellite navigation (GPS), a conductor for satellite radio, and a conductor for telematics/cellular. Signals from each of these types of antenna systems can have an associated frequency range. For instance, the satellite navigation signals can have a frequency of about 1.5 to about 1.6 gigahertz (GHz) and, more particularly, of about 1.57 GHz. The satellite radio signals can have a frequency of about 2.3 to about 2.4 MHz and, more particularly, from about 2.33 to about 2.34 MHz. The telematics signals can have a frequency of about 800 MHz for analog signals. The telematics signals can have a frequency range from about 800 MHz to about 1.9 GHz to about for digital signals.

FIG. 7 is another view of the example intermediate ground 120 of FIG. 6. In this view, some of the components (e.g., the vehicle frame member 200, bolt 240, trim panel, etc.) are removed for the sake of clarity. Further, additional components are shown in this view that are not present in FIG. 6. As an example, the second portion 174 of the plurality of conductors 170 can include a first set 410 and a second set 420 of one or more of the plurality of conductors 170. The first set 410 can include a third connector (not shown), and the second set 420 can include a fourth connector (not shown). In one or more arrangements, the third and/or fourth connector can be male connectors. In one or more arrangements, the third and/or fourth connector can be female connectors. The third and/or fourth connectors can be any standard connector, now known or later developed. The third connector can be operatively connected to the first connector 330, and the fourth connector can be operatively connected to the second connector 340.

Now that the various potential systems, devices, elements and/or components of the vehicle 100 and the intermediate ground have been described, one manner of assembling the intermediate ground will now be described. The various components described herein can be assembled in any suitable manner. Various possible steps will now be described. The described steps may be applicable to the arrangements described above in relation to FIGS. 1-7, but it is understood that the steps can be carried out with other suitable systems and arrangements. Moreover, steps other than those described here can be included, and in fact, arrangements are not limited to including every step described. Further, while a particular chronological order may be described, arrangements described herein are not limited to any particular chronological order. Indeed, some of the steps may be performed in a different order than what is described and/or at least some of the described steps can occur simultaneously.

The vehicle frame member 200 and the ground bracket 10 can be brought together so that the frame engaging portion 14 of the ground bracket 10 and the ground bracket engaging region 210 of the vehicle frame member 200 contact each other. In one or more arrangements, there can be metal to metal contact between the ground bracket 10 and the vehicle frame member 200. For example, in one or more arrangements, there can be substantially mating engagement between the outer side 24 of the frame engaging portion 14 of the ground bracket 10 and the ground bracket engaging region 210 of the vehicle frame member 200. In one or more arrangements, the outer side 24 of the frame engaging member can be substantially flat, and the bracket engaging region 210 of the frame member can be substantially flat.

The through hole 26 in the ground bracket 10 can be substantially aligned with an aperture (not shown) in the vehicle frame member 200. Further, the anti-rotation tab 28 can be received in the aperture 230 in the vehicle frame member 200.

The ground bracket 10 can be attached to the vehicle frame member 200 using a bolt 240 or other suitable fastener. The bolt 240 can extend through the hole 26 and into the aperture in the vehicle frame member 200. It will be appreciated that when the bolt 240 is tightened, the engagement between the anti-rotation tab 28 and the associated aperture 230 can prevent rotation of the ground bracket 10. The bolt 240 or other fastener can be retainably engaged by threaded engagement with the vehicle frame member 200 or by a retainer element (e.g., a nut).

With the ground bracket 10 attached to the vehicle frame member 200, the first connector 330 can engage the first connector post 30 so as to be supported on the second end region 13 of the ground bracket 10. For instance, the first connector post 30 can be received in the first cassette 335 of the first connector 330. Such engagement can include a portion of the first connector 330 (e.g., a protrusion) engaging the aperture 34 in the first connector post 30. Thus, an electrical connection can be established between the ground bracket 10 and the first set 310 of one or more of the plurality of conductors 170.

The second connector 340 can engage the second connector post 40 so as to be supported on the second end region 13 of the ground bracket 10. As an example, the second connector post 40 can be received in the second cassette 345 of the second connector 340. Such engagement can include a portion of the second connector 340 (e.g., a protrusion) engaging the aperture 44 in the second connector post 40. Thus, an electrical connection can be established between the ground bracket 10 and the second set 320 of one or more of the plurality of conductors 170.

The first portion 172 of the plurality of conductors 170 can be operatively connected to the second portion 174 of the plurality of conductors 170. For instance, the third connector (not shown) can be operatively connected to the first connector 330, and the fourth connector (not shown) can be operatively connected to the second connector 340. In one or more arrangements, the first and second connectors 330, 340 can be female connectors, and the third and fourth connectors can be male connectors. In such case, the third and fourth connectors can be received in the first and second connectors 330, 340, respectively.

It will be appreciated that arrangements described herein can provide numerous benefits, including one or more of the benefits mentioned herein. For example, arrangements described herein can provide a compact intermediate ground within a vehicle. Due to the compact design of intermediate ground brackets described herein, the bracket can be mounted in various locations within a vehicle. Further, the intermediate ground brackets described herein are not used to mount an antenna. Arrangements described herein can reduce the packaging space within a vehicle. Arrangements described herein can save cost by reducing the number of intermediate grounds needed, which, in turn, can reduce the number of parts in the vehicle as well as part cost. Arrangements described herein can improve the time and cost of the assembly process of a vehicle. Arrangements described herein can help to reduce electrical noise within a vehicle. As a result, the signal to noise ratio of the antenna signals carried by the plurality of conductors can be increased. Arrangements described herein can be used in connection with numerous types of antenna signals (e.g., AM radio, FM radio, satellite radio, telematics, and/or satellite navigation). Arrangements described herein can be used in connection with a wide frequency band, from kilohertz (kHz) to gigahertz (GHz). Arrangements herein can be used in connection with high frequency bands, such as, for example, up to about 2.4 GHz.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. An intermediate ground for a vehicle comprising:

a vehicle frame member;

a ground bracket attached to the vehicle frame member, the ground bracket including a body made of a conductive material, the body including:

a first end region including a frame engaging portion, the frame engaging portion defining a through hole, at least a portion of the frame engaging portion directly contacting the vehicle frame member; and a second end region opposite to the first end region, the second end region including a first electrical connector supporting portion and a second electrical connector supporting portion, one of the first electrical connector supporting portion and the second electrical connector supporting portion being substantially U-shaped, and the other one of the first electrical connector supporting portion and the second electrical connector supporting portion being substantially L-shaped, the first electrical connector supporting portion including a first post, the second electrical connector supporting portion including a second post, the first post and the second post being configured to support an electrical connector thereon, whereby the second end region is configured to separately support a plurality of electrical connectors thereon, the first post including an aperture therein, the second post including an aperture therein, the first post being oriented at substantially 90 degrees relative to the second post, the first post being substantially parallel to the frame engaging portion, and the second post being substantially perpendicular to the frame engaging portion, the first post including a first distal end, the second post including a second distal end, the first distal end being offset from the second distal end such that the second distal end is located closer to the frame engaging portion that the first distal end, the through hole being substantially aligned with the second post, the through hole being laterally offset from the first post;

a first electrical connector, the first electrical connector being configured to be operatively connected to an end of a first cable; and a second electrical connector, the second electrical connector being configured to be operatively connected to an end of a second cable, the first electrical connector and the second electrical connector being separately supported on the second end region of the ground bracket.

2. The intermediate ground of claim 1, wherein the vehicle frame member is an A-pillar frame member.

3. The intermediate ground of claim 1, further including at least one fastener, wherein the ground bracket is attached to the vehicle frame member by the at least one fastener.

4. The intermediate ground of claim 1, wherein the body further includes an anti-rotation tab extending from the frame engaging portion, and wherein the anti-rotation tab engages an aperture defined by the vehicle frame member, whereby rotation of the ground bracket on the vehicle frame member is minimized.

5. The intermediate ground of claim 1, wherein the body includes one or more bends between the first end region and the second end region.

6. An intermediate ground system for a vehicle comprising:

a first set of one or more antennas;

a second set of one or more antennas;

an intermediate ground including:

a vehicle frame member; and a ground bracket attached to the vehicle frame member, the ground bracket being made of a conductive material, the ground bracket including:

a first end region including a frame engaging portion, the frame engaging portion defining a through hole, at least a portion of the frame engaging portion directly contacting the vehicle frame member; and a second end region opposite to the first end region, the second end region including a first electrical connector supporting portion and a second electrical connector supporting portion, one of the first electrical connector supporting portion and the second electrical connector supporting portion being substantially U-shaped, and the other one of the first electrical connector supporting portion and the second electrical connector supporting portion being substantially L-shaped, the first electrical connector supporting portion including a first post, the second electrical connector supporting portion including a second post, the first post and the second post being configured to support an electrical connector thereon, whereby the second end region is configured to separately support a plurality of electrical connectors thereon, the first post including an aperture therein, the second post including an aperture therein, the first post being oriented at substantially 90 degrees relative to the second post, the first post being substantially parallel to the frame engaging portion, and the second post being substantially perpendicular to the frame engaging portion, the first post including a first distal end, the second post including a second distal end, the first distal end being offset from the second distal end such that the second distal end is located closer to the frame engaging portion that the first distal end, the through hole being substantially aligned with the second post, the through hole being laterally offset from the first post;

a first set of one or more conductors, the first set of one or more conductors being operatively connected at one end to the first set of one or more antennas, the first set of one or more conductors being operatively connected at an opposite end to a first electrical connector; and a second set of one or more conductors, the second set of one or more conductors being operatively connected at one end to the second set of one or more antennas, the second set of one or more conductors being operatively connected at an opposite end to a second electrical connector, the first electrical connector and the second electrical connector being supported on the second end region of the ground bracket.

7. The intermediate ground system of claim 6, wherein the first set of one or more conductors carry signals from the first set of one or more antennas, wherein the signals from the first set of one or more antennas have an associated frequency, wherein the frequency is in the range from about 500 kilohertz to about 110 megahertz, and wherein the second set of one or more conductors carry signals from the second set of one or more antennas, wherein the signals have an associated frequency, wherein the frequency is in the range from about 800 megahertz to about 2.4 gigahertz.

8. The intermediate ground system of claim 6, wherein the first set of one or more antennas includes at least one AM/FM radio antenna, and wherein the second set of one or more antennas includes at least one of: a satellite radio antenna, a satellite navigation antenna, or a telematics antenna.

9. A ground bracket comprising:

a body made of an electrically conductive material, the body including:

a first end region including an engaging portion configured to engage a ground member, the engaging portion defining a through hole; and a second end region opposite to the first end region, the second end region including a first electrical connector supporting portion and a second electrical connector supporting portion, one of the first electrical connector supporting portion and the second electrical connector supporting portion being substantially U-shaped, and the other one of the first electrical connector supporting portion and the second electrical connector supporting portion being substantially L-shaped, the first electrical connector supporting portion including a first post, the second electrical connector supporting portion including a second post, the first post and the second post being configured to support an electrical connector thereon, whereby the second end region is configured to separately support a plurality of electrical connectors thereon, the first post including an aperture therein, the second post including an aperture therein, the first post being oriented at substantially 90 degrees relative to the second post, the first post being substantially parallel to the engaging portion, and the second post being substantially perpendicular to the engaging portion, the first post including a first distal end, the second post including a second distal end, the first distal end being offset from the second distal end such that the second distal end is located closer to the engaging portion than the first distal end, the through hole being substantially aligned with the second post, the through hole being laterally offset from the first post.

10. The ground bracket of claim 9, wherein the body includes one or more bends between the first end region and the second end region.

11. The ground bracket of claim 9, further including an anti-rotation tab extending transversely from the engaging portion, the anti-rotation tab being substantially located on a different side of the body than the first and second posts.

* * * * *